US005540061A

United States Patent [19]

Gommori et al.

[11] Patent Number: 5,540,061

[45] Date of Patent: Jul. 30, 1996

[54] REFRIGERATOR

[75] Inventors: Masahiko Gommori; Katsutoshi Shinohara, both of Tochigi-ken; Takahiro Kaneko, Imaichi; Hiroaki Hata; Akihiko Ishiyama, both of Tochigi-ken, all of Japan

[73] Assignee: Hitachi, Ltd., Tokyo, Japan

[21] Appl. No.: 740

[22] Filed: Jan. 5, 1993

[30] Foreign Application Priority Data

Jan. 9, 1992 [JP] Japan ..... 4-001839

[51] Int. Cl.[6] ..... F25D 17/00

[52] U.S. Cl. ..... 62/277; 62/238.6; 62/505; 62/452

[58] Field of Search ..... 62/440, 441, 238.6, 62/272, 277, 283, 505, 506, 452

[56] References Cited

U.S. PATENT DOCUMENTS

| | | | |
|---|---|---|---|
| 2,146,484 | 2/1939 | Philipp | 62/505 |
| 2,175,946 | 10/1939 | Smith | 62/506 |
| 2,793,506 | 5/1957 | Moody | 62/505 |
| 2,904,971 | 9/1959 | Kosfeld | 62/505 |
| 2,994,208 | 8/1961 | Hanson | 62/283 |
| 4,023,377 | 5/1977 | Tomita | 62/196 |
| 4,497,183 | 2/1985 | Gelbard et al. | 62/295 |
| 4,522,040 | 6/1985 | Ochiai et al. | 62/419 |

*Primary Examiner*—Henry A. Bennett
*Assistant Examiner*—William C. Doerrler
*Attorney, Agent, or Firm*—Antonelli, Terry, Stout & Kraus

[57] ABSTRACT

A refrigerator comprises a compressor for compressing and discharging a coolant, a first heat exchanger which performs heat exchange between the compressed coolant from the compressor and the atmosphere to cool the compressed coolant, an adiabatic expansion orifice where the compressed and cooled coolant after passing the first heat exchanger is adiabatically expanded, and a second heat exchanger which performs heat exchange between the adiabatically expanded coolant and the air in refrigerating chambers so as to cool the air in the refrigerating chambers by the coolant and to heat the coolant by the air in the refrigerating chambers. The refrigerator further includes a third heat exchanger which performs heat exchange between water produced when frost attached on the refrigerating chambers is melted and the compressed coolant discharged from the compressor so as to heat and evaporate the water, and a fourth heat exchanger which performs heat exchange between the compressed coolant and the atmosphere so as to cool the compressed coolant. The third heat exchanger and the fourth heat exchanger are connected in series so that the compressed coolant discharged from the compressor is supplied to the first heat exchanger after it passes and is cooled by both the third and fourth heat exchangers.

12 Claims, 5 Drawing Sheets

REFRIGERATOR

BACKGROUND OF THE INVENTION AND RELATED ART STATEMENT

The present invention relates to a refrigerator having refrigerating chambers.

The refrigeration cycle in a conventional refrigerating apparatus uses a closed cycle circuit which connects a compressor, a condenser, a decompression device, an evaporator and so forth through conduits. In this connection, while the compressor is being operated, a high-temperature high-pressure gas adiabatically compressed by the compressor radiates heat and is condensed by the condenser. The gas is decreased in pressure by the decompression device, such as a capillary tube, and then, it is evaporated by the evaporator, to thereby perform heat exchange.

Methods of heat exchange between the evaporator and a thermal load of the refrigerator can be classified into a direct cooling type in which direct contact with the surface of the evaporator causes heat conduction and an indirect cooling type in which forcible circulation by a fan causes convection. Thus, chambers of the refrigerator of this type, e.g., a freezer/refrigerator, are cooled. In order to maintain each of the chambers at a required temperature, the compressor is controlled to operate/stop by thermostats installed in the refrigerating chambers.

Referring to FIG. 5, the refrigeration cycle circuit comprises a rotary compressor 1 which includes a cylinder C of a compression mechanism portion thereof, a condenser **2*b* for evaporating defrosting water, a condenser 3 whose radiation means are an outer frame of the refrigerator, decompression means 4 (e.g., a capillary tube), an evaporator 5 which is a component part of cooling means of the refrigerator, a discharge pipe 7, and a suction pipe 14**.

In FIG. 6, reference numeral 9 denotes a body of the refrigerator. A vegetable container 10 includes a door 11. A heat insulating material 13 is filled inside of a separation wall of the refrigerator body 9. The refrigerator includes a machine chamber 15 which is formed at a rear lower side portion of the refrigerator body 9. Other component parts of the refrigeration cycle circuit are denoted by the same reference numerals as FIG. 5.

The rotary compressor 1 is installed in the machine chamber 15. The discharge pipe 7 and the suction pipe 14 of the refrigeration cycle circuit are provided as shown in FIG. 6.

Although not illustrated in the drawings, Japanese Patent Unexamined Publication No. 60-251377, for instance, discloses a refrigerator having a refrigeration cycle circuit in which a compressed coolant gas is returned from a cylinder of a compression mechanism portion into a sealed container through a precooling piping system so as to precool the compressor before it is circulated through a condenser, a depression device and an evaporator.

OBJECT AND SUMMARY OF THE INVENTION

It is an object of the present invention to provide a refrigerator in which a compressed coolant can be effectively cooled before adiabatic expansion.

According to this invention, a refrigerator having refrigerating chambers comprises a compressor which compresses a coolant and discharges the compressed coolant, a first heat exchanger which performs heat exchange between the compressed coolant discharged from the compressor and the atmosphere so as to cool the compressed coolant, an adiabatic expansion orifice where the compressed and cooled coolant, after passing the first heat exchanger, is adiabatically expanded, and a second heat exchanger which performs heat exchange between the adiabatically expanded coolant after passing the adiabatic expansion orifice and the air in the refrigerating chambers so as to cool the air in the refrigerating chambers by the coolant and to heat the coolant by the air in the refrigerating chambers. The refrigerator further includes a third heat exchanger which performs a heat exchange between water produced when frost attached on the refrigerating chambers is melted and the compressed coolant discharged from the compressor so as to heat and evaporate the water, and a fourth heat exchanger which performs heat exchange between the compressed coolant discharged from the compressor and the atmosphere so as to cool the compressed coolant. The third heat exchanger and the fourth heat exchanger are connected in series so that the compressed coolant discharged from the compressor is supplied to the first heat exchanger after it passes and is cooled by both the third and fourth heat exchangers.

In addition to the component parts of the conventional refrigerator, the refrigerator according to the invention includes the third heat exchanger which performs heat exchange between water produced when frost attached on the refrigerating chambers is melted and the compressed coolant discharged from the compressor so as to heat and evaporate the water, and the fourth heat exchanger which performs heat exchange between the compressed coolant discharged from the compressor and the atmosphere so as to cool the compressed coolant. The third heat exchanger and the fourth heat exchanger are connected in series so that the compressed coolant discharged from the compressor is supplied to the first heat exchanger after it passes and is cooled by both the third and fourth heat exchangers. Before adiabatic expansion, the compressed coolant discharged from the compressor is cooled by the third and fourth heat exchangers which are connected in series, and then, it is further cooled by the first heat exchanger. Thus, the coolant cooling is carried out effectively.

DETAILED DESCRIPTION OF THE PREFERRED EMBODIMENTS

Figure 1:
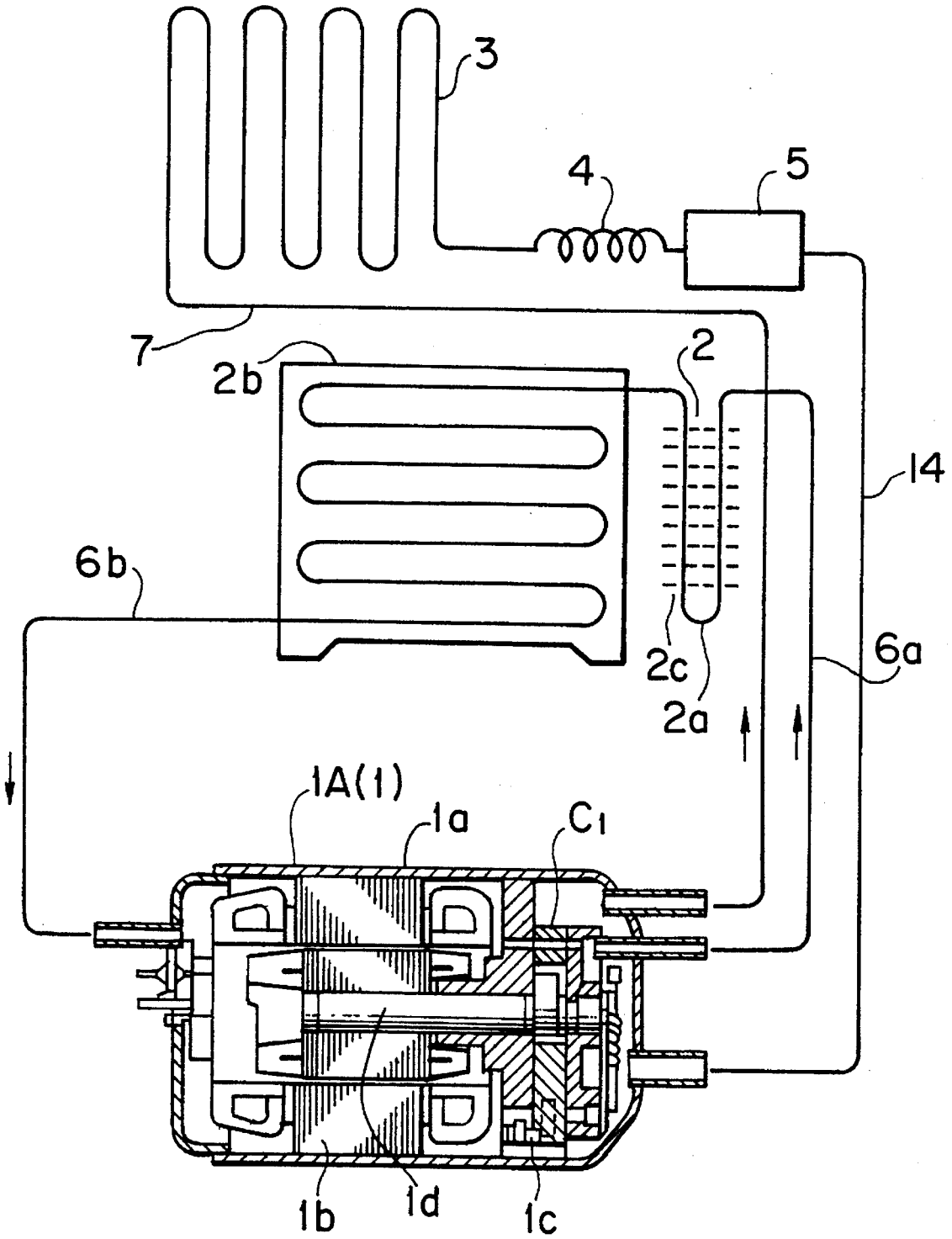
FIG. 1 is a system diagram illustrative of a refrigeration cycle circuit of a refrigerator according to one embodiment of the present invention.

Referring to FIG. 1, in accordance with one embodiment of the present invention, a refrigeration cycle circuit comprises a rotary compressor 1A, a radiator 2, a radiator pipe 2*a*, radiation fins 2*c* provided outside of the radiator pipe 2*a*, a condenser 2*b* for evaporating defrosting water, a condenser 3 whose radiation means are an outer frame of a refrigerator, decompression means 4 (e.g., a capillary tube), an evaporator 5 which is a component part of cooling means of the refrigerator, pipings 6*a*, 6*b* which connect the rotary compressor 1A and the radiator 2, a discharge pipe 7, and a suction pipe 14.

The rotary compressor 1A in this embodiment includes a sealed container 1*a* which contains a compression mechanism portion 1*c* for compressing a coolant and a motor portion 1*b* for driving the compression mechanism portion 1*c* through a rotational shaft 1*d*. It is a horizontal-type electric compressor with the rotational shaft 1*d* extending substantially horizontally.

In this refrigeration cycle circuit, for example, HFC134a is sealingly filled as a substitution coolant for CFC12.

Figure 3:
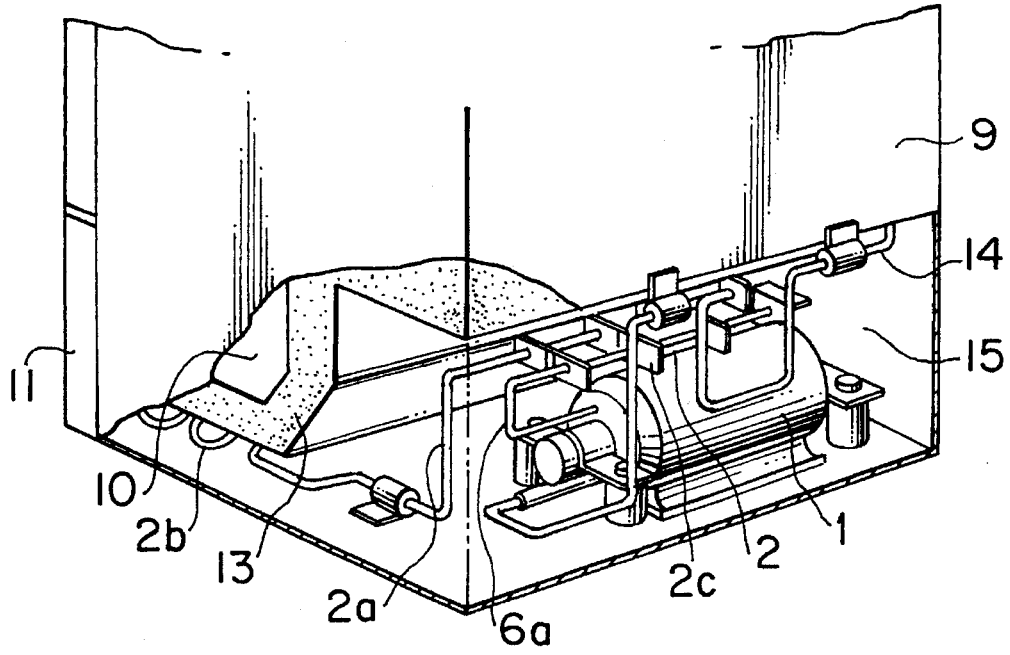
FIG. 3 is a perspective view showing a machine chamber of the refrigerator according to the one embodiment of the invention.
Figure 4:
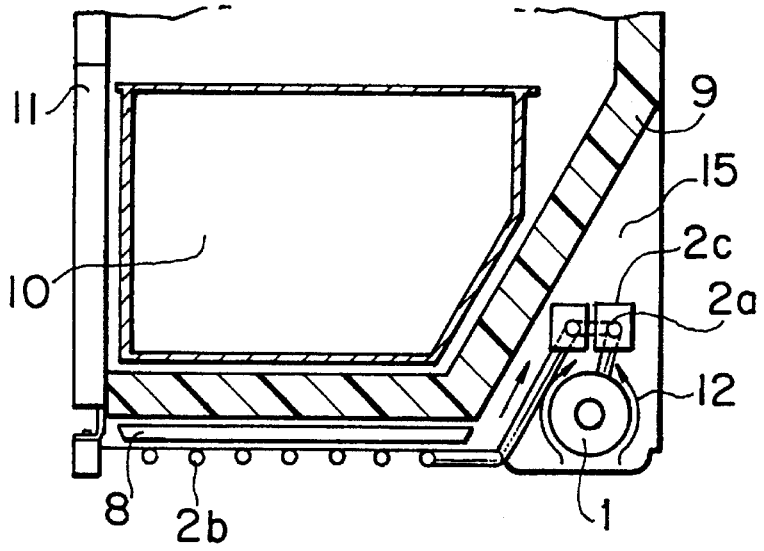
FIG. 4 is a vertical cross-sectional view showing the machine chamber of the refrigerator shown in FIG. 3.
Figure 5:
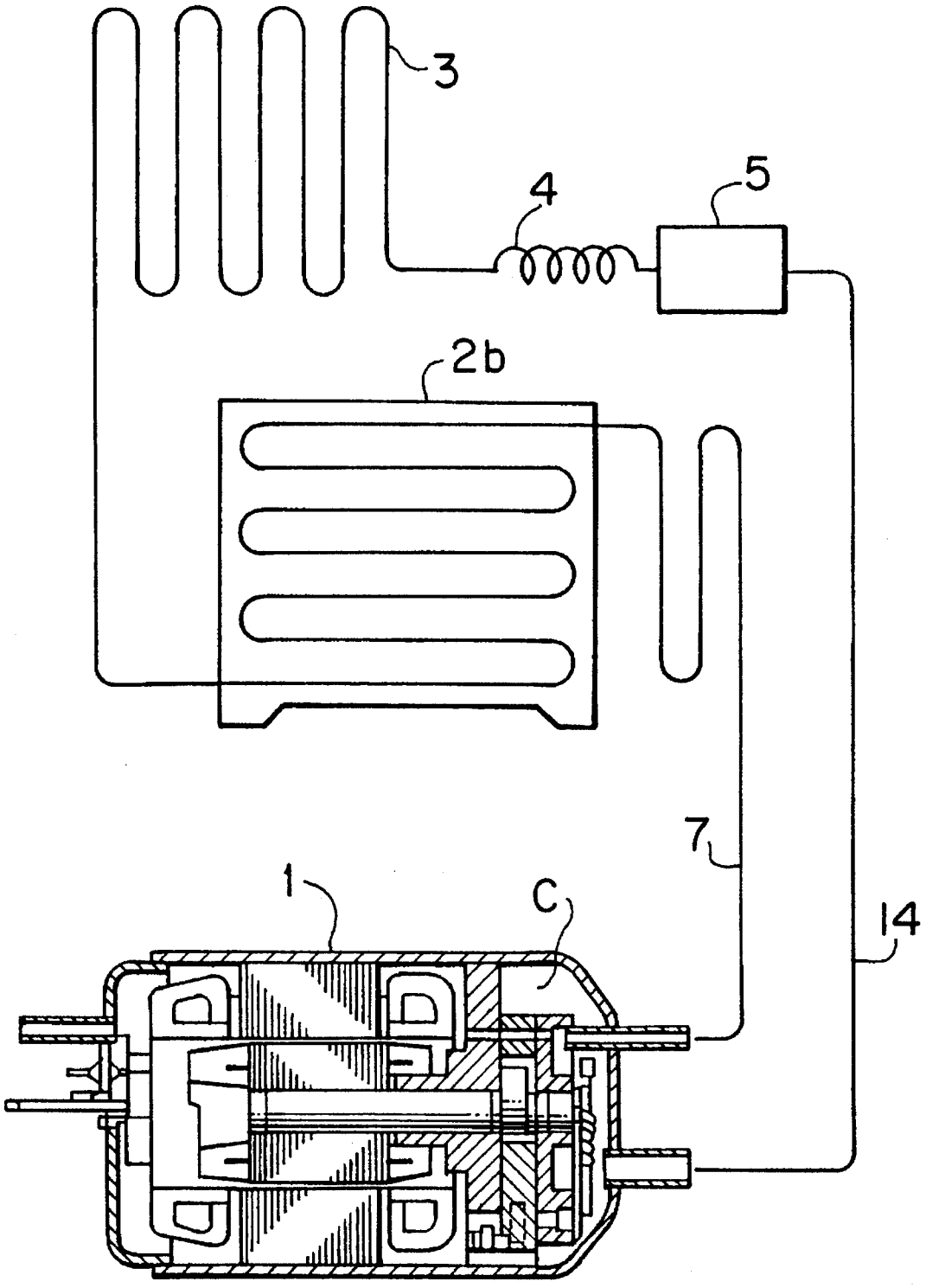
FIG. 5 PRIOR ART
FIG. 5 is a system diagram illustrative of a refrigeration cycle circuit of a conventional refrigerator.
Figure 6:
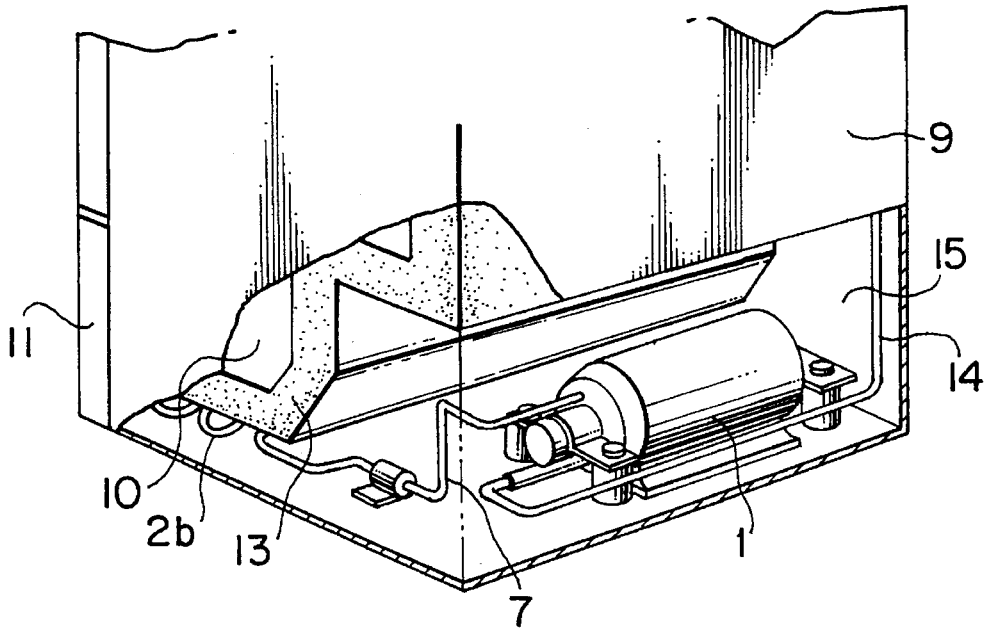
FIG. 6 PRIOR ART
FIG. 6 is a perspective view showing a machine chamber of the conventional refrigerator.
Figure 7:
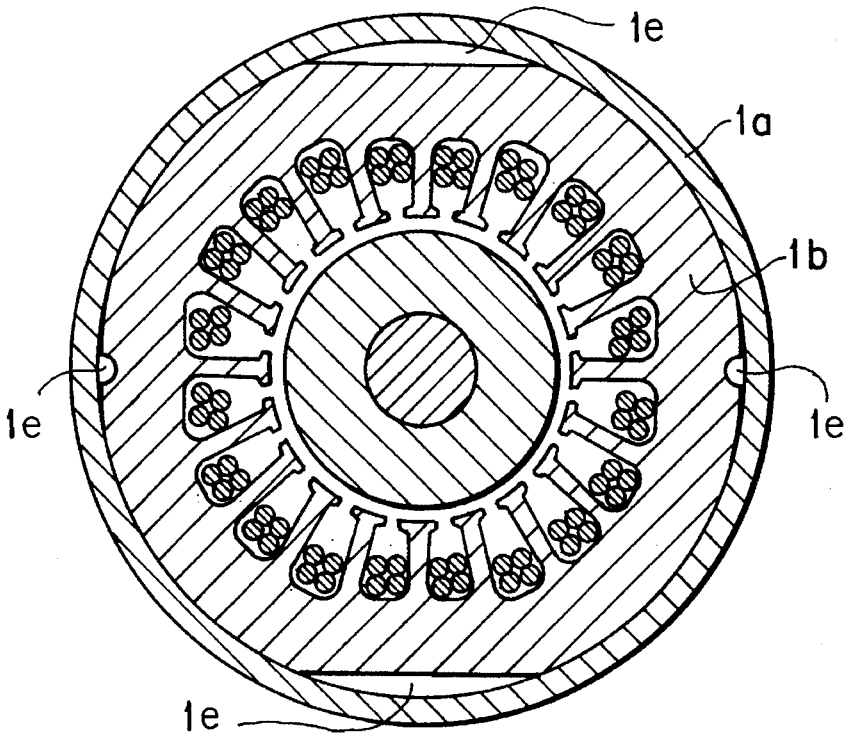
FIG. 7 is a cross-sectional view showing coolant conduits around a motor of a compressor shown in FIG. 2.

In FIGS. 3 and 4, reference numeral 8 denotes a defrosting water evaporating plate, and 9 denotes a body of the refrigerator. A vegetable container 10 includes a door 11. A heat insulating material 13 is filled inside of a separation wall of the refrigerator body 9. The refrigerator includes a machine chamber 15 which is formed at a rear lower side portion of the refrigerator body 9. Other component parts of the refrigeration cycle circuit are denoted by the same reference numerals as FIG. 1.

The rotary compressor 1A is installed in the machine chamber 15. The piping 6*a* of the precooling piping system, and the radiator pipe 2*a* and the radiation fins 2*c* of the radiator 2 are provided on an upper portion of the rotary compressor 1A, as shown in FIGS. 3 and 4.

The coolant, compressed in the rotary compressor 1A, flows in the piping 6*a* of the precooling piping system including a chamber 20 which prevents the coolant from flowing into the radiator 2 with pressure vibration. Then, the coolant flows through the radiator 2 and the condenser 2*b* for evaporating defrosting water, and is returned into the sealed container 1*a* of the rotary compressor 1A by way of the piping 6*b*. While passing through coolant conduits 1*e*, the coolant pre-cools the motor portion 1*b* and the compression mechanism portion 1*c*. After that, by way of the discharge gas pipe 7, the coolant flows into the condenser 3 which uses the outer frame of the refrigerator as the radiation means.

In this embodiment, the radiator pipe 2*a* is located above the compressor. Air flows 12, generated around the outer surface of the rotary compressor 1 (1A) at a high temperature, directly collide against the radiator pipe 2*a* and the radiation fins 2*c*, as indicated by the solid arrows in FIG. 4. Consequently, the temperature boundary zone becomes thin, and the heat conductivity is improved in comparison with the case of natural convection. Since the heat-conduction area is also increased by the existence of the radiation fins 2*c*, the amount of heat exchange can be several times larger than the conventional case, and the temperature of the compressor motor and the temperature of adiabatically compressed discharge gas can be decreased.

Moreover, the heat-conduction area of the radiator 2 is designed such that the temperature of the condenser 3 which uses the outer frame of the refrigerator as the radiation means can be not more than a touch non-dangerous temperature (a temperature at which a human hand can touch: about 40° C.).

The refrigerator having the refrigeration cycle circuit of the above-described structure operates in the following manner when it is started.

When chambers of the refrigerator are cooled down to a predetermined temperature, sensors in the refrigerator, such as thermostats, function to stop the rotary compressor 1A. When the temperature in the refrigerator is increased again, the sensors function to resume operation of the rotary compressor 1A. In the case where the ambient temperature of the refrigerator is high and the refrigerator is surrounded by shielding objects, the operation factor of the rotary compressor 1A is high, and therefore, the temperature of the compressor motor and the temperature of adiabatically compressed discharge gas are raised.

However, as for the high-temperature gas coolant introduced to the radiator 2 from a cylinder C1 of the rotary compressor 1A, the air flows 12 generated around the outer surface of the rotary compressor 1A directly collide against the radiator pipe 2*a* and the radiation fins 2*c*, so that the temperature boundary zone becomes thin, and that the heat conductivity is improved in comparison with the case of natural convection. Since the heat-conduction area is also increased by the existence of the radiation fins 2*c*, the amount of heat exchange can be made larger than the conventional case. Consequently, the temperature of the compressor motor and the temperature of adiabatically compressed discharge gas can be decreased. Not only because the heat conductivity on the surfaces of the radiator pipe 2*a* and the radiation fins 2*c* is improved, but also because that component part of the refrigeration cycle circuit which has a temperature largely different from the ambient air temperature serves to provide a heat-conduction area of the condenser which controls the amount of heat radiation, the total efficiency of heat radiation is enhanced.

As a result, the coolant in the radiator 2 radiates a large amount of heat toward the atmosphere, so that the coolant at a decreased temperature will be returned into the sealed container 1*a* of the rotary compressor 1A. Therefore, the motor portion 1*b* and the compression mechanism portion 1*c* inside of the rotary compressor 1A are cooled and decreased in temperature, and also, the temperature of adiabatically compressed discharge gas is decreased. According to results of an experiment, if the length of the condenser 2*b* for evaporating defrosting water as a radiator is about 5 m, the temperature of adiabatically compressed discharge gas and the temperature of the compressor motor can be decreased to substantially the same level as in the case where the coolant is CFC12. Thus, it is possible to carry out the refrigeration cycle operation equivalent to the case of CFC12 even if the substitution coolant HFC134a is used, as described above.

According to this embodiment, in the case where HFC134a considered to be a substitution coolant for CFC12 is used, the temperature of the compressor motor and the temperature of adiabatically compressed discharge gas can be decreased, and the reliability of the compressor, the refrigerator oil and the refrigeration cycle circuit can be improved.

Moreover, by decreasing the temperature of the compressor, the volumetric efficiency of the compression mechanism portion is improved to increase the refrigerating capacity, thereby reducing the demand of electricity of the refrigerator.

Furthermore, because the heat-conduction area of the radiator is designed such that the temperature of the condenser which uses the outer frame of the refrigerator as the radiation means will be not more than the touch non-dangerous temperature (about 40° C.), the safety can be improved, thus preventing the user from being physically damaged.

Figure 2:
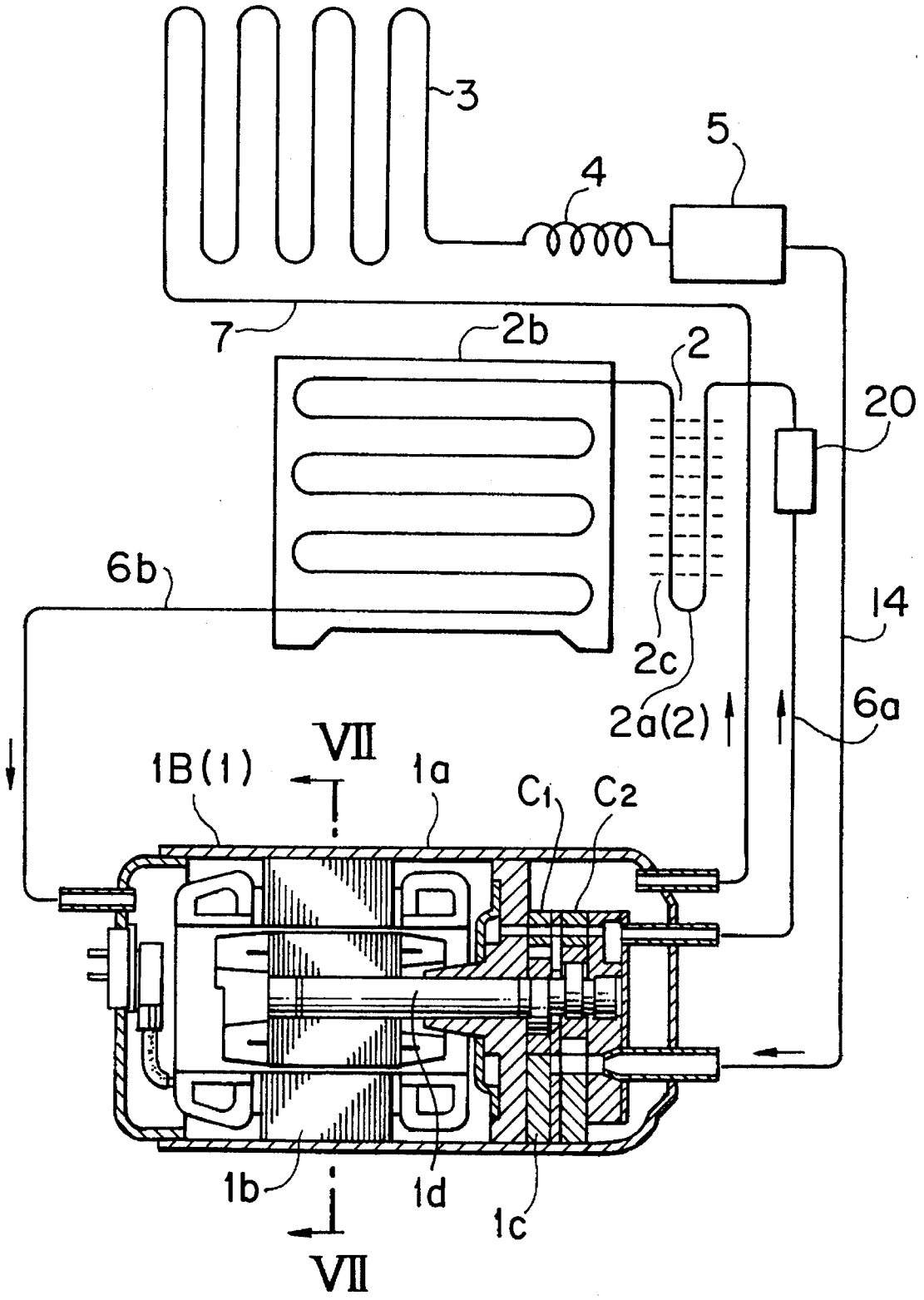
FIG. 2 is a system diagram illustrative of a refrigeration cycle circuit of a refrigerator according to another embodiment of the invention.

In the embodiment of FIG. 2, common component parts are denoted by the same reference numerals as FIG. 1 so that explanations thereof will be omitted. A machine chamber of a refrigerator in which a refrigeration cycle circuit shown in FIG. 2 is provided has substantially the same condition as in FIGS. 3 and 4.

The embodiment of FIG. 2 is different from the embodiment of FIG. 1 in that a rotary compressor 1B has two cylinders. More specifically, the rotary compressor 1B shown in FIG. 2 includes a compression mechanism portion 1*c* consisting of two cylinders C1, C2.

In a refrigerator with the refrigeration cycle circuit shown in FIG. 2, the compression mechanism portion 1*c* includes the two cylinders C1, C2, so that torque pulsation in the compression step can be smoothed, and that a rotational shaft 1*d* can be easily balanced. Therefore, from the embodiment of FIG. 2, substantially the same effect as the embodiment of FIG. 1 can be expected. Especially, vibration of the compressor can be reduced to about ½ to ⅓ of the conventional case, and noise in an actually installed condition can be decreased by about 3 to 5 dB, so as to improve comfort of the user. Besides, due to a decrease in vibration, the reliability of the refrigeration cycle piping is improved. Consequently, it is possible to remove butyl sheets and the like for insulating vibration and noise, which have conventionally been required, to thereby reduce the manufacturing costs of products.

What is claimed is:

1. A refrigerator with refrigerating chambers provided therein, the refrigerator comprising:

a compressor which compresses a coolant and discharges the compressed coolant;

a first heat exchanger which performs heat exchange between the compressed coolant discharged from said compressor and the atmosphere so as to cool the compressed coolant;

an adiabatic expansion orifice where the compressed and cooled coolant, after passing said first heat exchanger, is adiabatically expanded; and a second heat exchanger which performs heat exchange between the adiabatically expanded coolant after passing said adiabatic expansion orifice and the air in said refrigerator so as to cool the air in the refrigerating chambers by the coolant and to heat coolant by the air in the refrigerating chambers, wherein said refrigerator further includes a third heat exchanger which performs heat exchange between water produced when frost attached on the refrigerating chambers is melted and the compressed coolant so as to heat and evaporate the water, and wherein the compressed coolant is supplied to said third heat exchanger after it is cooled by said first heat exchanger.

2. A refrigerator according to claim 1, further comprising a fourth heat exchanger which performs heat exchange between the compressed coolant and the atmosphere so as to cool the compressed coolant, and, wherein the compressed coolant is supplied to said fourth heat exchanger after it is cooled by the third heat exchanger.

3. A refrigerator according to claim 2, wherein the compressed coolant cools the compressor after it passes and is cooled by both said third heat exchanger and said first heat exchanger, and wherein the compressed coolant is supplied to said fourth heat exchanger after it cools the compressor.

4. A refrigerator according to claim 2, wherein said compressor is provided in a sealed container, and the compressed coolant flows into said sealed container and cools the compressor after is passes and is cooled by both said third heat exchanger and said first heat exchanger, and the compressed coolant is supplied to said fourth heat exchanger after it cools the compressor.

5. A refrigerator according to claim 1, wherein said first heat exchanger performs heat exchange between air flows generated when the atmosphere is heated by the compressor and the compressed coolant discharged from the compressor.

6. A refrigerator according to claim 1, wherein said first heat exchanger is provided above said compressor.

7. A refrigerator according to claim 1, wherein a volume chamber is provided between said first heat exchanger and said compressor.

8. A refrigerator according to claim 1, wherein said adiabatic expansion orifice is a capillary tube.

9. A refrigerator according to claim 3, wherein said compressor comprises a pump mechanism which compresses the coolant and a motor which drives the pump mechanism, so that the compressed coolant cools said motor after it passes and is cooled by both said third heat exchanger and said first heat exchanger, and wherein the compressed coolant cools said pump mechanism after it cools said motor.

10. A refrigerator according to claim 1, wherein said compressor comprises a pump mechanism which compresses the coolant and a motor which drives the pump mechanism, said pump mechanism and said motor being juxtaposed horizontally.

11. A refrigerator according to claim 1, wherein said coolant is fluorocarbon 134*a*.

12. A refrigerator according to claim 1, wherein said compressor has two chambers which vary in volume so as to compress the coolant.

* * * * *